US011807984B2

(12) United States Patent
Gupta

(10) Patent No.: US 11,807,984 B2
(45) Date of Patent: Nov. 7, 2023

(54) WET PROCESSING TECHNIQUE FOR PRODUCING TERRY FABRICS

(71) Applicant: Trident Limited, Sanghera (IN)

(72) Inventor: Abhishek Gupta, Ludhiana (IN)

(73) Assignee: Trident Limited

( * ) Notice: Subject to any disclaimer, the term of this patent is extended or adjusted under 35 U.S.C. 154(b) by 23 days.

(21) Appl. No.: 17/350,307

(22) Filed: Jun. 17, 2021

(65) Prior Publication Data

US 2022/0010487 A1 Jan. 13, 2022

(30) Foreign Application Priority Data

Jun. 22, 2020 (IN) ..... 202011026198

(51) Int. Cl.

| | |
|---|---|
| ***D06P 5/20*** | (2006.01) |
| ***D06B 21/00*** | (2006.01) |
| ***D06C 19/00*** | (2006.01) |
| ***D06M 15/71*** | (2006.01) |
| ***D06M 16/00*** | (2006.01) |

(52) U.S. Cl.

CPC ..... *D06P 5/2072* (2013.01); *D06B 21/00* (2013.01); *D06C 19/00* (2013.01); *D06M 15/71* (2013.01); *D06M 16/003* (2013.01)

(58) Field of Classification Search

CPC ..... D06P 5/2072; D06B 21/00; D06C 19/00; D06M 15/71; D06M 16/003

See application file for complete search history.

(56) References Cited

U.S. PATENT DOCUMENTS 10,240,283 B2 3/2019 Gupta et al.

FOREIGN PATENT DOCUMENTS

| | | | | |
|---|---|---|---|---|
| CN | 102021840 A | | 4/2011 | |
| CN | 102051805 A | | 5/2011 | |
| CN | 102505502 A | | 6/2012 | |
| WO | 2014064661 A2 | | 5/2014 | |
| WO | WO2014/064661 | * | 5/2014 | ..... D03D 15/00 |
| WO | 2018026368 A1 | | 2/2018 | |

OTHER PUBLICATIONS

Ciloglu, Emirhan. AIRO 24 tumbler success in the application to the terry towel sector has been striking. Sep. 6, 2018. https://www.textilegence.com/en/airo-24-tandem-double-production/.*

* cited by examiner

*Primary Examiner* — Amina S Khan
(74) *Attorney, Agent, or Firm* — Lerner David LLP

(57) ABSTRACT

An improved wet processing method for producing improved terry fabrics is provided. Woven fabric is treated based on enzymatic treatment process including de-sizing using optimized dosage of predetermined de-sizing ingredients, washed and bio-washed using optimized dosage of bio-washing ingredients. Enzyme treated fabric is pre-treated and subjected to hot air beat-up process comprising mechanically treating pre-treated fabric with optimized hot air beat-up parameters. Air is blown onto pre-treated fabric from both directions for predetermined duration and at predetermined frequency causing to and fro movement of fabric in tumbling chambers of tumbling machine resulting in an instantaneous impact produced on every pile loop of pre-treated fabric such that fibers rearrange in a path of least resistance to produce relaxed, open and aligned fiber structure in the fabric. Mechanically treated hot air-beaten up fabric is dyed and includes finishing the dyed fabric with softener and subjected to tumbling using optimized finishing parameters.

11 Claims, 4 Drawing Sheets

WET PROCESSING TECHNIQUE FOR PRODUCING TERRY FABRICS

FIELD OF THE INVENTION

The present invention relates to textile manufacturing and more particularly to an improved wet processing technique to produce terry fabrics exhibiting enhanced softness, hulk, absorbency, hand-feel, reduced lint loss, improved pile standing ability without use of Poly Vinyl Alcohol (PVA).

BACKGROUND OF THE INVENTION

Fabrics are flexible materials produced from fibers, yarns or threads. Fabrics may be categorized into woven, knitted and also some non-woven fabric categories. The woven, knitted and non-woven fabric may be further categorized into terry fabrics, flat fabrics etc. Terry fabrics, also known as, toweling fabrics are generally thick, and are manufactured with an aim to absorb greater amount of water and moisture. Terry fabrics, may be made from 100% cotton fiber yarns, yarns made from fiber blends such as cotton and viscose, blends of cotton and modal, blends of silk and modal, and blends of cotton and polyester yarns. Conventional processes of manufacturing soft terry fabrics comprises using cotton yarns and yarns made from a blend of cotton and Polyvinyl alcohol ("PVA") fibers, where the PVA fibers in the fabric, that exhibit a unique property of dissolving in hot water, are dissolved during a wet processing stage of fabric manufacture, thereby producing empty spaces within the structure of yarn and making the fabric soft and bulky. Typically, conventional processes involve doubling base yarn with PVA yarn in opposite direction to un-twist base yarn or involve inserting PVA fibres in the yarn across cross-section of the yarn or in the core of the yarn. It has been observed that these methods produced fabrics which are not durable and exhibit inferior appearance after several repeated washes. Moreover, usage of PVA is detrimental to the environment and PVA recovery from effluent treatment plant is a costly process. Further, the process of blending cotton and PVA fibers is costly. Furthermore, it has been observed that the fabric obtained using the conventional wet processing methods exhibit lint loss and shrinkage.

In light of the aforementioned drawbacks, there is a need for a process for manufacturing terry fabrics exhibiting enhanced softness, bulk, absorbency, hand-feel, reduced lint loss, improved pile standing ability without using PVA. Yet further, there is a need for an improved process which produces fabrics that exhibit high wettability, easy dry ability, and quick absorbency. Yet further, there is a need for a process which is cost effective, economical and environment friendly.

SUMMARY OF THE INVENTION

In various embodiments of the present invention, an improved wet processing method for producing improved terry fabrics is provided. The method comprises the steps of treating a woven fabric based on an enzymatic treatment process, wherein the woven fabric is de-sized using optimized dosage of predetermined de-sizing ingredients, washed and bio-washed using optimized dosage of bio-washing ingredients. The method further comprises pre-treating the enzyme treated fabric and subjecting the pre-treated fabric to a hot air beat-up process. The hot air beat-up process comprises mechanically treating the pre-treated fabric in open-width in a textile tumbling machine with optimized hot air beat-up parameters, wherein air is blown onto the pre-treated fabric from both directions for a predetermined duration and at a predetermined frequency causing to and fro movement of the fabric in tumbling chambers of the tumbling machine resulting in an instantaneous impact produced on every pile loop of the pre-treated fabric such that built in stress within fibers and the pile loops is released and the fibers rearrange in a path of least resistance to produce a relaxed, open and aligned fiber structure in the fabric. The method further comprises dyeing the mechanically treated hot air-beaten up fabric and finishing the dyed fabric, wherein the dyed fabric is dried and finished with a softener, and subjected to tumbling using optimized finishing parameters to obtain an improved terry fabric.

In an embodiment of the present invention, the woven fabric is woven from pile yarn having TM between 2.0 and 3.4 during spinning at a ring frame or at a modified ring frame. Further, the enzyme treated fabric is pre-treated including scouring and bleaching. Furthermore, the pre-treated fabric is partly dried until 10% to 20% moisture is retained.

In an embodiment of the present invention, the de-sizing step comprises loading the woven fabric in a machine for de-sizing, raising the temperature of the machine up to 85-95 degree centigrade, adding the optimized dosage of de-sizing ingredients in the machine, and dwelling the woven fabric for a predetermined duration of 10-20 minutes.

In an embodiment of the present invention, the optimized dosage of de-sizing ingredients comprises an enzyme optimized to 0.5 gram per litre (gpl), green acid optimized to 1 gram per litre (gpl), and wetting agent optimised to 0.5 grams per litre (gpl).

In another embodiment of the present invention, the step of bio-washing comprises water filling, raising temperature up to 55-65 degree centigrade, adding the optimised dosage of bio-washing ingredients, dwelling the woven fabric for a predetermined duration of for 25-35 minutes, draining water, hot wash, cold wash and unloading of fabric. The bio-washing ingredients include a bio-washing agent of 0.4% of dry fabric weight, green acid optimized to 1 gram per litre (gpl) and a wetting agent optimized to 1.5 gpl.

In an embodiment of the present invention, the optimized hot air beat-up parameters include speed of the tumbling machine ranging between 12-18 mpm, temperature of tumbling chambers ranging between 150 to 180 degree centigrade, duration of beating between 07 minutes to 15 minutes and frequency of beating of about 03 seconds. The hot air beaten-up fabric is dyed using any of the standard dyeing processes selected from pad steam dyeing or cold pad dyeing.

In an embodiment of the present invention, the optimized finishing parameters include, speed of the tumbling machine ranging between 12-18 mpm (meter per minute), temperature of tumbling chambers ranging between 150 to 180 degree centigrade, duration of beating between 07 minutes and 15 minutes and frequency of beating of about 3 seconds beat up and 3 seconds dwell, and further repeating the same cycle of beat-up and dwell.

BRIEF DESCRIPTION OF DRAWINGS

These and other features, aspects, and advantages of the present invention will become better understood when the following detailed description is read with reference to the accompanying drawings, wherein.

DETAILED DESCRIPTION OF THE INVENTION

Figure 1:
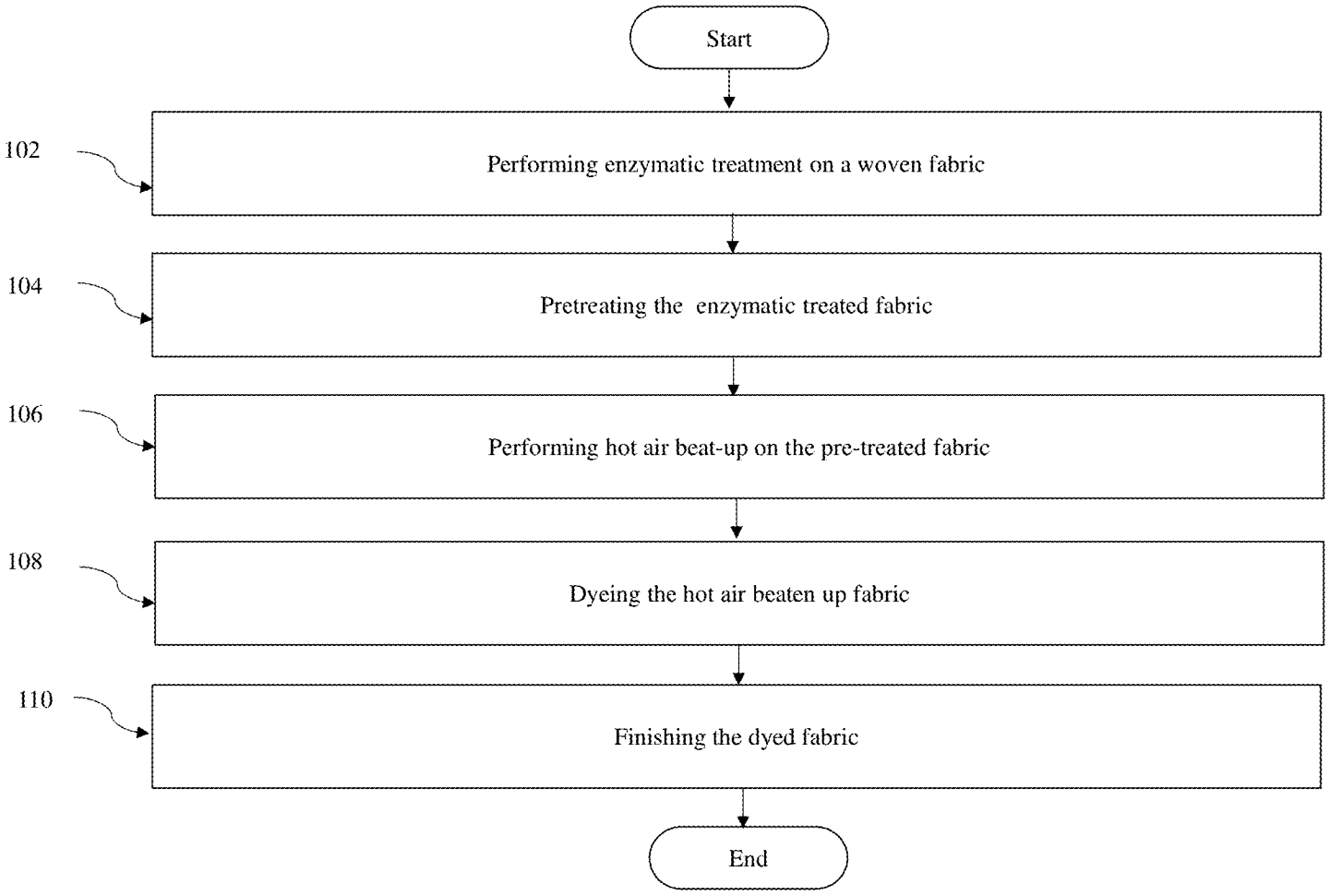
FIG. 1 is a flow chart illustrating an improved wet processing technique for producing terry fabrics exhibiting enhanced softness, bulk, hand feel reduced lint loss and improved pile standing ability without using PVA, in accordance with an embodiment of the present invention.

The present invention provides an improved wet processing technique for producing terry fabrics. In particular, the improved process of the present invention includes an optimized wet processing stage comprising an enzymatic treatment step and a hot air beat-up step to produce ultra-soft terry fabrics having enhanced, absorbency, hand-feel and bulk, reduced lint loss and improved pile standing capability without using Polyvinyl Alcohol (PVA). In operation, the improved process of the present invention comprises: obtaining a woven fabric by weaving a ground warp yarn, a low TM pile warp yarn and a weft yarn using optimized weaving parameters. Further, the improved process of the present invention comprises wet processing the woven fabric. The wet processing stage comprises the step of enzymatic treatment, where the woven fabric is de-sized, washed and bio-washed using optimized dosage of predetermined ingredients to inhibit lint loss tendency in the fabric. Further, the wet processing stage comprises a pre-treatment step where the soft processed fabric undergoes scouring and bleaching. Furthermore, the pre-treated fabric is subjected to a hot air beat-up step, where the pre-treated fabric is mechanically treated by blowing air, producing an instantaneous impact on every pile loop of the pre-treated fabric, and causing the loop to straighten longitudinally and release built in stress to obtain a relaxed, open and aligned fiber structure in the fabric. Further, the air blown fabric is dyed and finally, the dyed fabric is finished with softener and subjected to tumbling using optimized finishing parameters to obtain an improved terry fabric. The improved terry fabric exhibits enhanced softness, easy dry ability, quick absorbency and increased thickness and improved pile standing capability due to longitudinal straightening of the pile loops, and alignment in fabric structure. Additionally, the improved terry fabric inhibits lint loss due to enzymatic treatment process.

Exemplary embodiments herein are provided only for illustrative purposes and various modifications will be readily apparent to persons skilled in the art. The general principles defined herein may be applied to other embodiments and applications without departing from the spirit and scope of the invention. The terminology and phraseology used herein is for the purpose of describing exemplary embodiments and should not be considered limiting. Thus, the present invention is to be accorded the widest scope encompassing numerous alternatives, modifications and equivalents consistent with the principles and features disclosed herein. For purposes of clarity, details relating to technical material that is known in the technical fields related to the invention have been briefly described or omitted so as not to unnecessarily obscure the present invention.

Definitions of a few terms as used in the specification are provided below for ease of understanding.

English count (Ne)": Number of hanks of 840 yards per pound.

Hank: Mass per unit length of sliver (measure of linear mass density of sliver). A hank of wool is 560 yards, cotton and silk is 840 yards, and linen is 300 yards.

Absorbency—The propensity of a material to take in and retain liquid, generally water.

Blend—A textile containing two or more different types fibers, variants of the same fiber or different colors and grades of the same fiber.

Blending—The mixing of predetermined quantities of the same fiber taken from many lots or of different types of fiber to produce a uniform result.

Carding—A process in manufacturing spun yarn in which the fibers are separated, distributed, equalized and formed into a web. The web can be very thin or thick. The process of carding removes some impurities, and a certain amount of short or broken fibers.

Doubling: The process of combing two or more carded sliver into a single form is called doubling.

Spinning: The final step in the production of yarn. The twisting of fibers in the form of the sliver or roving.

Denier: Refers to the thickness of a fiber. It is the measurement of the diameter of the fiber and refers to weight in grams for 9000 meters.

Pile: A surface effect on a fabric formed by tufts or loops of yarn that stand up from the body of the fabric such as terry towel fabric.

Warp: In woven fabric, the yarns that run lengthwise and are interwoven with the fill (weft) yarns.

Weft: In woven fabric, the filling yarns that runs perpendicular to the warp yarns.

Yarn: A continuous strand of textile fibers created when a cluster of individual fibers are twisted around one another.

Base material: refers to cotton, cotton blends, silk, modal fibers, acrylic, blends of cotton and bamboo, blends of cotton and sea weeds, blends of cotton and silver, blends of cotton and charcoal, blends of polyester and cotton, blends of polyester and viscose, blends of cotton and modal and combinations thereof.

Polyvinyl alcohol ("PVA")—a man-made water soluble material fiber material having unique property of dissolving in hot water, Porosity: Porosity is the ratio of the volume of openings (voids) to the total volume of material. Porous surface of the yarn having more air gaps in the yarn structure provide quick absorption and early shedding of water that is being absorbed.

Wettability: Wettability or wetting is the actual process when a liquid spreads on a solid substrate or material. It can be estimated by determining the contact angle or calculating area of spreading or time taken to spread.

IPI stands for Imperfection Index of yarns—Imperfections is the description for thin, thick places and neps in 1000 m of yarn.

The present invention would now be discussed in context of embodiments as illustrated in the accompanying drawings.

In various embodiments of the present invention, an improved wet processing technique for manufacturing a terry fabric exhibiting enhanced softness, absorbency, bulk, hand-feel, reduced lint loss and improved pile standing capability is provided. In an embodiment of the present invention, the terry fabric is obtained by weaving and the process of obtaining the woven fabric includes interlacing a plurality of warp yarns with a plurality of weft yarns using one or more weaving patterns. In particular, a plurality of ground warp yarns, a plurality of pile warp yarns and a plurality of weft yarns are interlaced using optimized weaving parameters. In an embodiment of the present invention, the optimized weaving parameters include, but are not limited to, size percentage, picks per inch and picks per minute. In an exemplary embodiment of the present invention, the optimized size percentage is 2%, picks per inch is 40 and picks per minute is 550 revolutions per minute.

In an embodiment of the present invention, the ground warp, the pile warp and the weft yarn may be selected from 100% pure cotton, cotton blends, processed or greige cotton, silk fibers, modal fibers, lyocell (Tencel), greige or dyed acrylic fibers, greige or dyed polyester, polybutylene terephthalate (PBT), recycled polyester, polytrimethylene terephthalate (PTT), any other cellulose based stable fiber, blends of cotton and bamboo, blends of cotton and sea weed fibers, blends of cotton and lyocell fibers, and blends of cotton and charcoal fibers. In an exemplary embodiment of the present invention, at least one of: the ground warp, the pile warp and the weft yarn is a 100% pure cotton natural fiber spun yarn having increased volume, homogeneous fiber distribution across cross section with low packing density. The 100% pure cotton natural fiber spun yarn exhibits increased diameter, more air pockets, low Imperfection Index (IPI) and less hairiness. In a preferred embodiment of the present invention, the natural fiber spun yarn is used as a pile warp yarn. The ground warp yarn and the weft yarn may be selected from materials including, but are not limited to, polyester, modal, lyocell and cotton and its blends of polyester & viscose; blends of polyester & cotton; blends of cotton and modal; blends of cotton and silk and modal; blends of cotton and bamboo; blends of cotton and sea weed fibers; blends of cotton and silver fibers; blends of cotton and charcoal fibers, and any combinations thereof.

In a preferred embodiment of the present invention, the pile warp is a true twist yarn having a low twist multiplier (TM) ranging from between 2.0 TM to 3.4 TM depending on count, staple length of corresponding fiber and spinning technique. In an exemplary embodiment of the present invention, the twist multiplier of the ground warp yarn may be selected from a range 3.8 to 6.0 TM. In an exemplary embodiment of the present invention, the weft yarn may be a ring spun or open-ended yarn having a twist multiplier ranging from 3.2 to 4.8 TM. In an embodiment of the present invention, the ground warp yarn and the weft yarn may have a count ranging from 3 s to 60 s. In an exemplary embodiment of the present invention, percentage of the natural fiber spun yarn as pile warp in the fabric may range from 30-80%. In an exemplary embodiment of the present invention, the low TM yarn has reduced hairiness across the cross-section of the yarn.

In an embodiment of the present invention, an improved terry fabric exhibiting enhanced softness, absorbency, bulk, hand-feel, reduced lint loss improved pile standing capability is obtained by using improved wet processing technique on the woven terry fabric produced from the low TM yarn. The wet processing technique comprises the steps of de-sizing, enzymatic treatment, pre-treatment, hot air beat-up, dyeing, and finishing including tumbling as explained later in the specification with reference to FIG. 1. In an exemplary embodiment of the present invention, the hot air heat-up is an open-width hot air heat-up. In another embodiment of the present invention, wet processing comprises the steps of enzymatic treatment, hot air beat-up, dyeing, and finishing including tumbling. Table 1 below lists exemplary structural parameters associated with the terry fabric obtained by the process of the present invention.

TABLE 1

| Product name | Eco soft Bath Towel |
|---|---|
| Size in cm | 76.2 X 137.16 |
| GSM | 506 |
| Reed/Ends/cm | 56/11.02 |
| Pick/cm | 16 |
| Pile height in mm | 5.9 |
| Pile Count | 1/12 CW (combed warp) |
| Ground Count | 2/24 KW (carded warp) |
| Weft Count | 1/16 KW |
| Border Count | 2/20 CW |

FIG. 1 is a flow chart illustrating an improved wet processing method for producing terry fabrics exhibiting enhanced softness, absorbency, bulk, hand-feel, reduced lint loss and improved pile standing capability, in accordance with an embodiment of the present invention.

Referring to FIG. 1, at step 102, the woven fabric is subjected to an enzymatic treatment. In an embodiment of the present invention, the woven fabric is obtained from a low TM yarn and is subjected to the enzymatic treatment. The enzymatic treatment comprises de-sizing the woven fabric using optimized dosage of de-sizing ingredients. In an embodiment of the present invention, the de-sizing step comprises loading the woven fabric in a machine for de-sizing. In an exemplary embodiment of the present invention, the machine for de-sizing may be a softflow dyeing machine, machines with Pre-treatment Range (PTR) technology, Continuous Bleaching Range (CBR) machines or machines having pad batch process. Further, the temperature of the machine for de-sizing is raised up to a predefined range as mentioned in Table 2 below. Further, the de-sizing comprises adding optimized dosage of de-sizing ingredients in the machine and holding or dwelling the woven fabric for a predetermined duration as mentioned in Table 2 below. In an exemplary embodiment of the present invention, the de-sizing ingredients include green acid, de-sizing agent and a wetting agent. In an exemplary embodiment of the present invention, the de-sizing agent may be an amylase enzyme.

The optimized de-sizing conditions are exemplified below in Table 2.

TABLE 2

| De-sizing Conditions | |
|---|---|
| Enzyme | 0.3-1 GPL and preferably 0.5 GPL for softflow machine OR 1 ml/Kg for PTR machines |
| Green Acid | 1 GPL |
| Temperature | 85-95° C. |
| Dwell time | 10-20 Min (preferably 15 minutes) |

Further, the enzymatic treatment comprises washing the de-sized fabric. In an embodiment of the present invention, for soft-flow desizing, washing is carried out in a soft-flow machine. Yet further, the step of enzymatic treatment comprises bio-washing of the de-sized fabric obtained after washing using optimized dosage of predetermined ingredients for bio-washing to remove maximum number of protruding fibers from the de-sized fabric and inhibiting lint loss tendency in the fabric. In an embodiment of the present invention, the bio-washing step comprises water filling, temperature raising, adding optimized dosage of bio-washing ingredients, draining, hot wash, cold wash and unloading of fabric. The optimized bio-washing conditions are exemplified below in Table 3.

TABLE 3

| Bio-washing conditions | |
|---|---|
| Bio-washing agent | 0.4% of dry fabric weight or 2.5 ml/Kg in PTR machines |
| Green Acid | 1 GPL |
| Wetting Agent | 1.5 GPL |
| Temperature | 55-65° C. |
| Dwell time | 25-35 Min (At above said temperature) |

In an exemplary embodiment of the present invention, the total operation time of the enzymatic treatment step including de-sizing, and bio-washing, as explained above is 140-170 minutes.

Figure 1A:
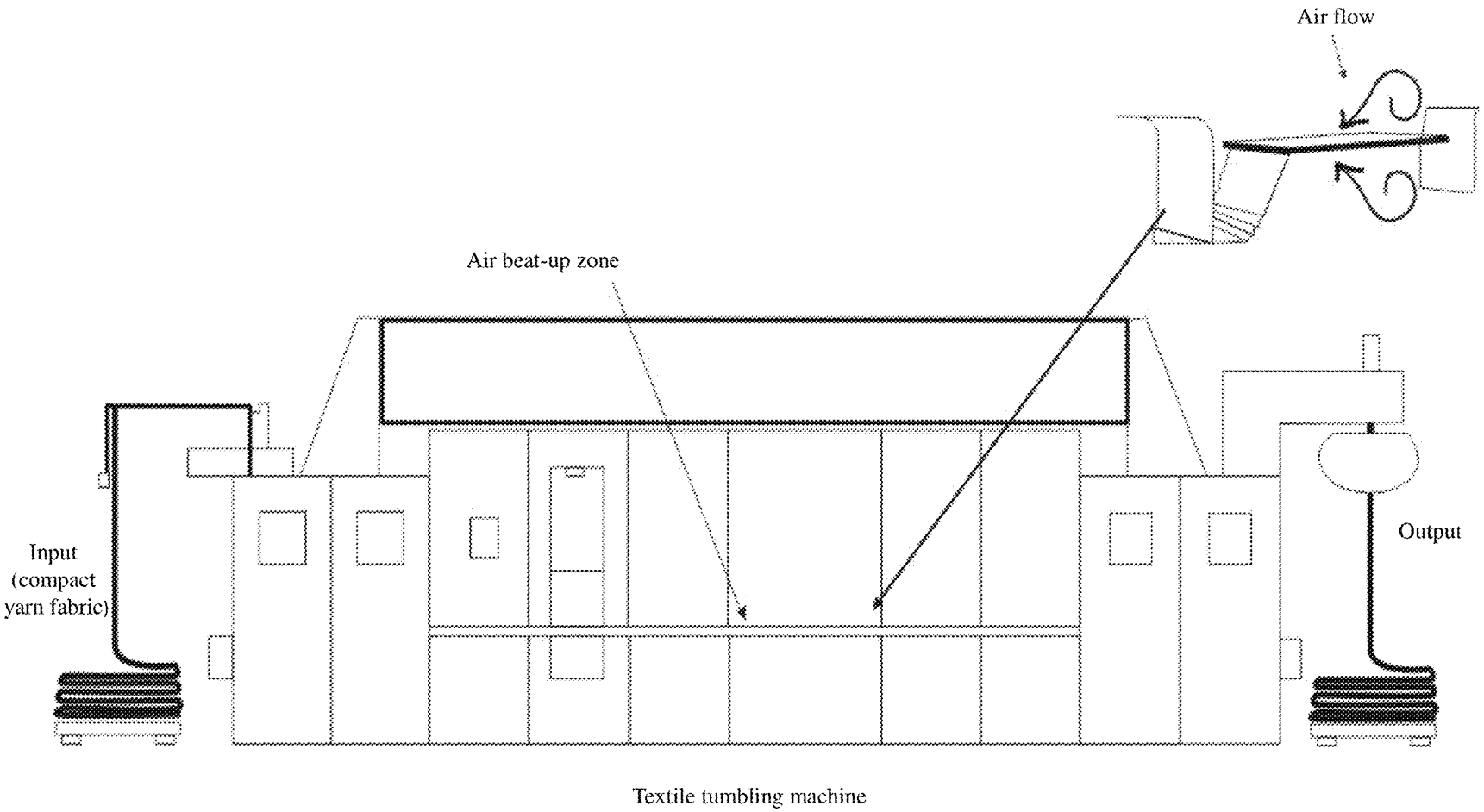
FIG. 1A illustrates air flow subjected on fabric in open-width during hot air beat-up in a textile finishing machinery, in accordance with an embodiment of the present invention.

At step 104, the enzyme treated fabric is subjected to a pre-treatment step. In an embodiment of the present invention, the step of pretreatment includes scouring and bleaching. At step 106, the pre-treated fabric is subjected to a hot air beat-up step. In an embodiment of the present invention, the pre-treated fabric material is partly dried until 10% to 20% moisture is retained. Further, the pre-treated fabric is mechanically treated in a textile tumbling machine with optimized air heat-up parameters. In operation, the pre-treated fabric is loaded on a J scray component of the textile tumbling machine. Further, the pretreated fabric moves into one or more tumbling chambers of the textile tumbling machine, where a temperature of 150 to 180 degree centigrade is maintained and air is blown onto the pre-treated fabric from both directions as shown in FIG. 1A. The air pressure exerted by the blown air onto the pre-treated fabric causes to and fro movement of the fabric in the tumbling chambers, and producing an instantaneous impact on every pile loop of the pre-treated fabric. The blowing air action causes a series of elongation and compression on each pile loop uniformly and causes the pile loop to straighten longitudinally. Subsequently, built in stress within the fibers and pile loops is released, and the fibers rearrange in the path of least resistance to produce a relaxed, open and aligned fiber structure in the fabric.

In an exemplary embodiment of the present invention, the textile tumbling machine is an AIRO® 24 machine. The AIRO®24 machine is operated with optimized air beat-up parameters as listed below in Table 4.

TABLE 4

| | |
|---|---|
| Airo ®24 speed | 12-18 mpm (metre per minute) (GSM (gram per square metre) ranges from 400-750)-low GSM towel requires low mechanical beat-up whereas high GSM requires more mechanical beat-up) |
| Temperature of tumbling chambers | (150 degree centigrade to 180 degree centigrade) |
| Duration of beating | 7 minutes-15 minutes |
| Frequency of beating | 03 seconds beat-up and 03 seconds dwell; and the same cycle is repeated |

At step 108, the hot air beaten-up fabric is dyed. In an embodiment of the present invention, the hot air beaten-up fabric is unloaded from the tumbling chambers of the textile finishing machinery. In an exemplary embodiment of the present invention, the hot air beaten-up fabric is dyed using any of the standard dyeing processes such as pad steam dyeing or cold pad dyeing. In an exemplary embodiment of the present invention, dyeing is carried out with suitable dyeing agent which is of suitable shade and depth %.

At step 110, the dyed fabric is subjected to a finishing step. In an embodiment of the present invention, the dyed fabric may be dried via one of: hydro extractor, rope opener, loop dryer and stenter. Further, the fabric is finished with softener and subjected to tumbling in a textile finishing machinery using optimized finishing parameters to obtain an improved terry fabric. In an exemplary embodiment of the present invention, the dosage of the softener may be 4 to 33 gpl suitable as per GSM of the Towel.

Figure 1B:
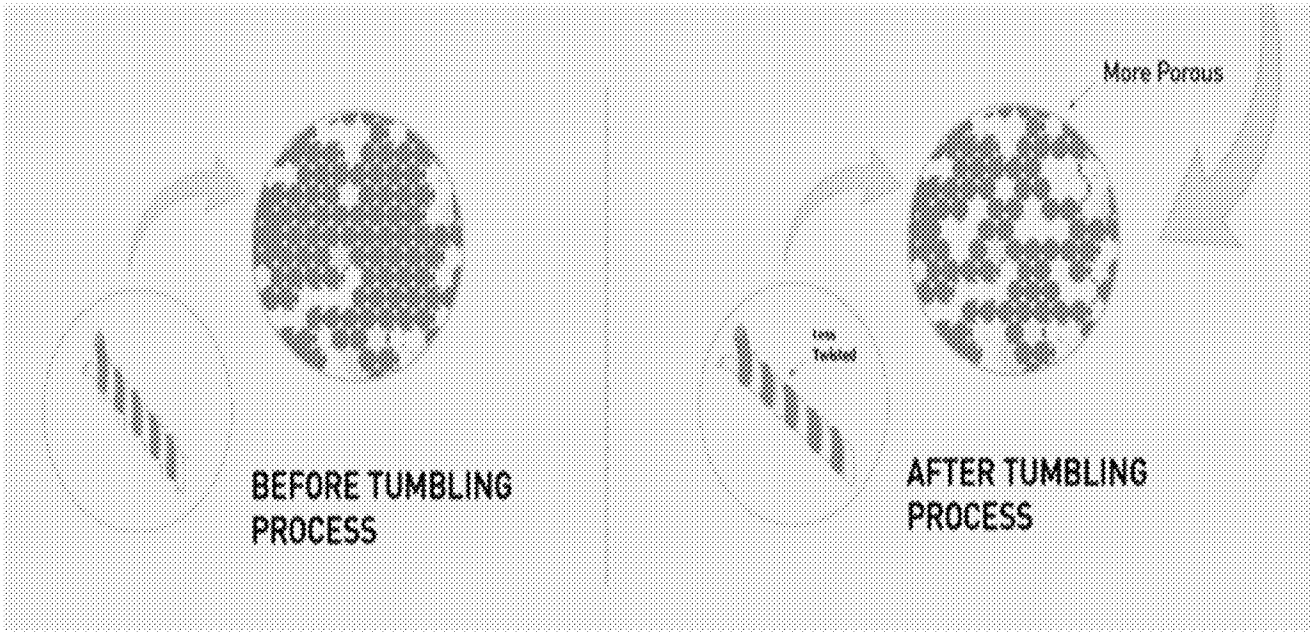
FIG. 1B illustrates fabric structure after the improved wet processing technique, in accordance with an embodiment of the present invention.
Figure 2:
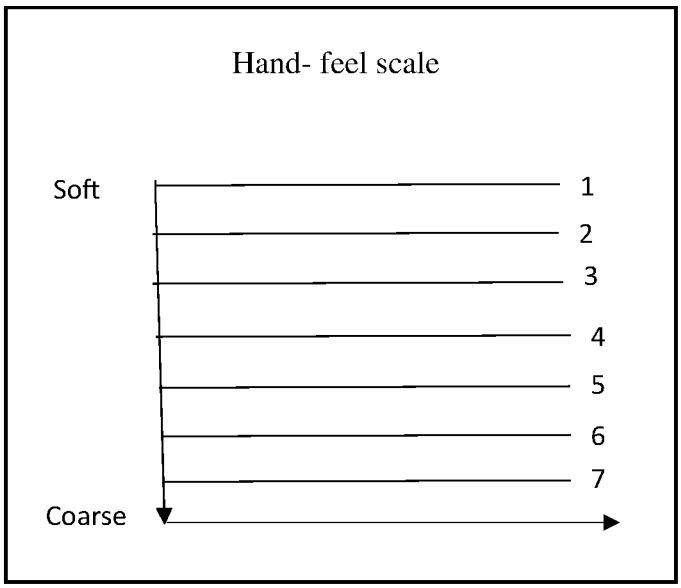
FIG. 2 illustrates a hand-feel scale associated with Table 6B.

In operation, the dyed fabric is loaded into the tumbling chambers of the textile tumbling machine via J scray component of the tumbling machine. The temperature of the tumbling chamber is raised and maintained between 150 and 180 degree centigrade. Further, air is blown onto the dyed fabric from both directions. The air pressure exerted by the blown air onto the pre-treated fabric causes to and fro movement of the dyed fabric in the tumbling chambers which produces an instantaneous impact on every pile loop of the dyed fabric. The blowing air action causes a series of elongation and compression on the pile loops and causes the pile loop to further straighten longitudinally. Subsequently, built in stress within the fibers and pile loops is released, and the fibers rearrange in the path of least resistance to produce a fabric structure with increased porosity. Further, apart from porosity thickness (bulkiness) of the fabric is improved. The fabric structure after improved wet processing technique of the present invention is shown in FIG. 1B. As shown in the figure the fabric structure after the wet processing technique is more porous than the fabric structure before wet processing.

In an exemplary embodiment of the present invention, the textile tumbling machine is an AIRO®24 machine. The AIRO®24 machine is operated with optimized finishing parameters as listed below in Table 5.

TABLE 5

| | |
|---|---|
| Airo −24 speed | 12-18 mpm (GSM ranges from 400-750) |
| Temperature of tumbling chambers | 150 degree centigrade to 180 degree centigrade |
| Duration of beating | 7 minutes to 15 minutes |
| Frequency of beating | 03 seconds |

Advantageously, in accordance with various embodiments of the present invention, the improved process of the present invention, more particularly, the improved wet processing technique of the present invention, unexpectedly causes longitudinal straightening of the pile loops, and alignment in the fabric structure, resulting in improvement in the terry fabric. The terry fabric manufactured without PVA using true twist yarn of low packing density and the improved wet processing technique of the present invention exhibits enhanced softness, easy dry-ability, quick absorbency, reduced lint loss, improved pile standing ability and increased thickness as compared to conventional 100% cotton towel and PVA towels. Additionally, the improved terry fabric inhibits lint loss due to enzymatic treatment process. The controlled alignment of pile loops and fibers in the fabric achieved results in enhancing softness and bulk in the fabric without using PVA. In various embodiments of the present invention, the controlled alignment of fibers in the fabric is achieved through the enzymatic treatment and hot air beat-up of the fabric before dyeing, along with precise computations and optimization of parameters such as optimum dosage of enzymatic treatment ingredients, speed of the machine for hot air heat up, and temperature of tumbling chambers, as has been demonstrated in accordance with various embodiments of the present invention, which has been obtained through extensive experimentation and application of inventive skill.

Table 6A and 6B below shows a comparative analysis between the woven fabric obtained from the improved wet processing process of the present invention and fabric obtained from conventional process using PVA. As shown in Table 6A, the terry fabric obtained from the improved process of present invention, exhibits reduced lint loss and enhanced absorbency (after wash) in comparison to terry fabric obtained from conventional process using PVA. Further, as shown in Table 6B, the fabric obtained from the process of the present invention has improved, hand-feel and washing performance.

TABLE 6A

| S. No. | Parameters | Woven Fabric (towel) produced using low TM yarn of TM 2.75 obtained through the improved wet processing process in an embodiment of the present invention | Conventional towel with PVA produced using yarn of 3.6 TM |
|---|---|---|---|
| 1. | GSM | 506 | 506 |
| 2. | Dimension Specification: | 137 × 76 cm | 137 × 76 cm |
| 3. | Weight/Pcs (Grams) | 537.00 | 524.00 |
| 4. | Lint loss % after 5 HL (Home Laundering) | 0.28 | 0.53 |
| 5. | Absorbency % before wash | 77 | 74 |
| 6. | Absorbency % after HL | 94 | 90 |

TABLE 6B

| | Woven Fabric (towel) produced using low TM yarn of TM 2.75 obtained through the improved wet processing process in an embodiment of the present invention | Conventional towel with PVA produced using yarn of 3.6 TM |
|---|---|---|
| Before Home Laundering | 1 | 2 |
| After 5X Home Laundering | 3 | 4 |
| After 10X Home Laundering | 5 | 6 |

While the exemplary embodiments of the present invention are described and illustrated herein, it will be appreciated that they are merely illustrative. It will be understood by those skilled in the art that various modifications in form and detail may be made therein without departing from or offending the spirit and scope of the invention.

We claim:

1. An improved wet processing method for producing improved terry fabrics, the method comprising the steps of:

treating a woven fabric made from pile yarn based on an enzymatic treatment process, wherein the enzymatic treatment process comprises de-sizing the woven fabric using an optimized dosage of de-sizing ingredients, washing the de-sized woven fabric and bio-washing the washed woven fabric using optimized dosage of bio-washing ingredients;

pre-treating the enzyme treated woven fabric and subjecting the pre-treated woven fabric to a hot air beat-up process, wherein the hot air beat-up process comprises mechanically treating the pre-treated woven fabric in open-width in a textile tumbling machine with optimized hot air beat-up parameters, wherein air is blown onto the pre-treated woven fabric from both directions for a predetermined duration and at a predetermined frequency causing to and fro movement of the woven fabric in tumbling chambers of the tumbling machine resulting in an instantaneous impact produced on every pile loop of the pre-treated woven fabric such that built in stress within fibers and the pile loops is released and the fibers rearrange in a path of least resistance to produce a relaxed, open and aligned fiber structure in the woven fabric;

dyeing the mechanically treated hot air-beaten up woven fabric; and finishing the dyed woven fabric, wherein the dyed woven fabric is dried and finished with a softener, and subjected to tumbling using optimized finishing parameters to obtain an improved terry fabric.

2. The method as claimed in claim 1, wherein the pre-treatment of the enzyme treated woven fabric comprises scouring and bleaching.

3. Method as claimed in claim 1, wherein the woven fabric is woven from pile yarn having a Twist Multiplier between 2.0 and 3.4 during spinning at a ring frame or at a modified ring frame.

4. The method as claimed in claim 1, wherein the pre-treated woven fabric is partly dried until 10% to 20% moisture is retained.

5. The method as claimed in claim 1, wherein the de-sizing step comprises loading the woven fabric in a machine for de-sizing, raising the temperature of the machine up to 85-95 degrees centigrade, adding the optimized dosage of de-sizing ingredients in the machine, and dwelling the woven fabric for a predetermined duration of 10-20 minutes.

6. The method as claimed in claim 1, wherein the optimised dosage of de-sizing ingredients comprises amylase enzyme in a range of 0.3 to 1 gram per litre (gpl), 1 gram per litre (gpl) of green acid, and 0.5 grams per litre (gpl) of wetting acid.

7. The method as claimed in claim 1, wherein the step of bio-washing comprises water filling, raising temperature up to 55 to 65 degrees centigrade, adding the optimised dosage of bio-washing ingredients, dwelling the woven fabric for a predetermined duration of for 25 to 35 minutes, draining water, hot wash, cold wash and unloading of fabric.

8. The method as claimed in claim 1, wherein the optimized dosage of bio-washing ingredients includes a bio-washing agent of 0.4% of dry fabric weight, 1 gram per litre (gpl) of green acid and 1.5 gpl of wetting agent.

9. The method as claimed in claim 1, wherein the optimized hot air beat-up parameters include speed of the tumbling machine ranging between 12-18 meter per minute (mpm), temperature of tumbling chambers ranging between 150 to 180 degrees centigrade, duration of beating between 07 minutes and 15 minutes and frequency of beating of about 03 seconds and dwell of 3 seconds.

10. The method as claimed in claim 1, wherein the hot air beaten-up fabric is dyed using a process selected from one or more of: soft flow, pad steam dyeing or cold pad dyeing.

11. The method as claimed in claim 1, wherein the optimised finishing parameters for finishing the woven fabric include, speed of the tumbling machine ranging between 12-18 mpm, temperature of tumbling chambers ranging between 150 to 180 degrees centigrade, duration of beating between 7 minutes and 15 minutes and frequency of beating of about 3 seconds beat up and 3 seconds dwell, and further repeating the same cycle of beat-up and dwell.

* * * * *